United States Patent [19]

Ricros

[11] 4,172,627

[45] Oct. 30, 1979

[54] MULTIPLE ELECTRICAL CONNECTING DEVICE

[76] Inventor: Andre P. Ricros, Calle Balmes, 292, Barcelona, Spain

[21] Appl. No.: 867,029

[22] Filed: Jan. 4, 1978

[30] Foreign Application Priority Data

Jan. 5, 1977 [ES] Spain ..... 225.483

[51] Int. Cl.[2] ..... H01R 13/20

[52] U.S. Cl. ..... 339/75 M

[58] Field of Search ..... 339/75 R, 75 A, 75 P, 339/76, 75 MP, 75 M, 91 R

[56] References Cited

U.S. PATENT DOCUMENTS 2,926,056 2/1960 Newcomer, Jr. ..... 339/75 M 3,575,482 4/1971 MacMaster ..... 339/75 M X

FOREIGN PATENT DOCUMENTS 1282756 11/1968 Fed. Rep. of Germany ..... 339/75 M

*Primary Examiner*—Joseph H. McGlynn

*Assistant Examiner*—John S. Brown

*Attorney, Agent, or Firm*—Clarence A. O'Brien; Harvey B. Jacobson

[57] ABSTRACT

A device for interlocking a plurality of male/female electrical connectors together to prevent inadvertent disconnection thereof, the invention comprises a base plate from which a raised enclosure extends, the enclosure having a plurality of male connector posts disposed therewithin which extend from the base plate. A frame bearing a raised member having a plurality of female apertured connectors disposed therein releasably interlocks with the base plate, the raised member being congruent with the enclosure on the base plate and being received into the enclosure such that the male connector posts mate with the female apertured connectors in the raised member. Pressure release and interlocking structure releasably maintain the male connector posts and female apertured connectors together.

7 Claims, 4 Drawing Figures

MULTIPLE ELECTRICAL CONNECTING DEVICE

BACKGROUND OF THE INVENTION

1. Field of the Invention

The invention relates generally to apparatus for interconnecting a multiplicity of electrical conductors, particularly conductors having male electrical connectors which are to be mated with female connectors to join said male connectors to individual circuits of which the female connectors form a portion.

2. Description of the Prior Art

Electrically powered equipment commonly available today require multiple electrical connections within the literally thousands of electrical circuits disposed in such equipment. Computers and communication switching apparatus are representative of such equipment, it being commonly necessary to group insulated wire conductors into "bundles", each conductor typically having a male connector disposed on one end thereof for mating with a female connector joined to a conductor of a circuit. Although the prior art has provided structure capable of locking a plurality of male and female connectors together, such prior art structures are bulky and severely limit the number of connections which can be made within a given space. Further, such prior devices are not readily assembled and, once assembled, cannot be quickly disconnected without special tools and/or expertise. The present invention provides a connector device capable of mounting a plurality of electrical conductors for interconnection therebetween in a minimum of space in order that the number of conductors connectable within a given space is maximized. Further, the present connector device can be rapidly assembled and disassembled to release the electrical connectors without the need for special tools or expertise.

SUMMARY OF THE INVENTION

The present invention provides a connecting device for interlocking a plurality of electrical conductors, that is, a "bundle" of conductors in a desired configuration. In particular, the present connecting device fixedly holds electrical conductors typically having male connectors formed on one end thereof one each within a plurality of female connectors disposed in a pattern and held on one portion of the connecting device. The female connectors mate at the ends thereof opposite to the male connectors with an identical pattern of male connector posts mounted on a separate portion of the device. The male connector posts electrically join to circuits and/or other conductors which are to be joined to the first-mentioned "bundle" of electrical conductors through the present connecting device. A frame slidable with respect to both the first and second portions of the device allows rapid manual interlocking and release of the connectors, release of the interlocking function of the device being accomplished with only manual pressure against an end portion of the device. On exertion of such pressure, the first portion of the device carrying the female connectors can readily be lifted from engagement with the male connector posts to disconnect the "bundle" of electrical conductors from electrical contact with the male conductor posts and thus the circuits and/or electrical conductors joined to said male conductor posts.

Accordingly, it is an object of the present invention to provide an electrical connecting device capable of fixedly but releasably mounting a plurality of electrical conductors, that is, a "bundle" of electrical conductors, having connectors on at least one end thereof, the electrical conductors thereby being connected to circuits or other electrical conductors.

It is another object of the present invention to provide an electrical connecting device for multiple electrical conductors capable of manual assembly and disassembly.

It is a further object of the invention to provide an electrical connecting device for interconnecting and releasably interlocking a plurality of electrical conductors, the device having a frame member mountable in a fixed position to lock mating male and female connectors together and being slidable relative to the male and female connectors to allow disengagement of said male and female connectors.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
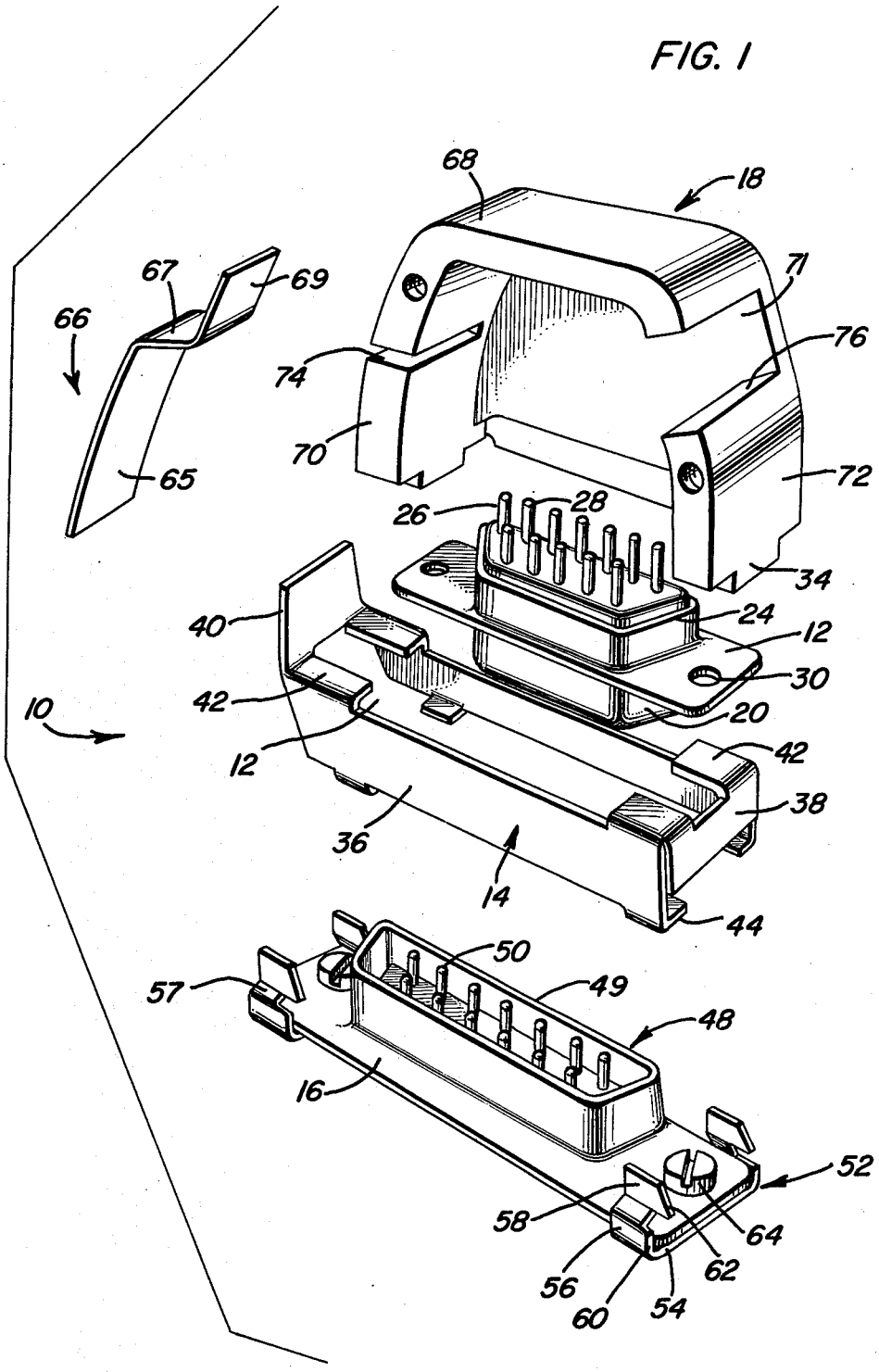
FIG. 1 is an exploded group perspective view illustrating the several portions of the present device in an assembly fashion.
Figure 2:
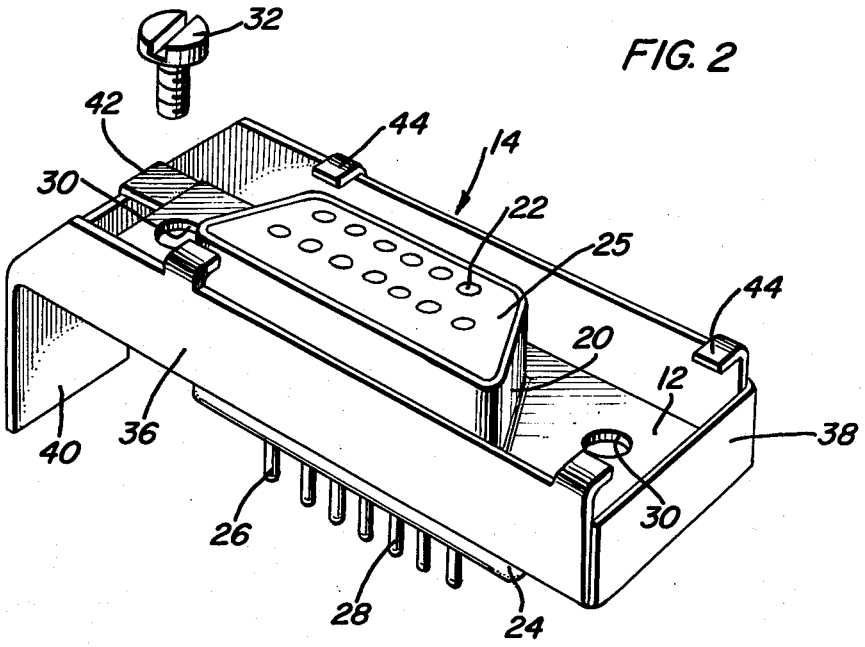
FIG. 2 is a perspective view illustrating a "bottom" portion of the sliding frame and mounting plate components of the present device.

Referring now to the drawings and particularly to FIGS. 1 and 2, the present connecting device is seen at 10 to comprise a free mounting plate 12, a slidable frame 14, and a fixed mounting plate 16. An insulating hood 18 may also be provided for insulating the electrical connections formed between the plates 12 and 16 from ambient. Referring particularly to FIG. 2, a lower projecting platform 20 is seen to extend from the underside of the free mounting plate 12, the platform 20 having a plurality of apertures 22 formed therein in a predetermined pattern. As can best be seen in FIG. 1, the free mounting plate 12 further has an upper projecting platform 24 extending from the opposite side thereof, the platform 24 having a plurality of tubular receptacles 26 extending from the surface thereof, the tubular receptacles 26 communicating one each with the apertures 22 in the lower projecting platform 20. As can readily be understood, the tubular receptacles 26 preferably extend through the platforms 20 and 24 to form continuous electrically conductive conduits therein. Alternatively, the walls of the apertures 22, or at least portions thereof, can be formed of an electrically conductive material which connects with the tubular receptacles 26 interiorly of the platforms 20 or 24. In either event, electrically conductive portions of the apertures 22 and the receptacles 26 are insulated from each other by insulative material 25 disposed therebetween. The lower projecting platform 20 is thereby seen to essentially form a "solid" structure projecting from the underside of the free mounting plate 12, the platform 20 comprising a "male" connective member as will be more fully described hereinafter. It is to be understood that the upper projecting platform 24 is preferably provided to support the tubular receptacles 26 to prevent breakage thereof. While it is possible to extend the tubular receptacles 26 from the surface of the plate 12, the upper projecting platform 24 acts to shorten the effective lengths of the receptacles 26 to thereby structurally support said receptacles and reduce breakage thereof. Lumens 28 of the tubular receptacles 26 essentially extend through the lower projecting platform 20 and communicate through the apertures 22 the respective sides of the free mounting plate 12. The tubular receptacles 26 are formed of an electrically conductive material such as is well-known in the art. The free mounting plate 12 is further provided with apertures 30 at each end thereof, the apertures 30 receiving screws 32 thereinto for connection with mating apertures (not shown) formed in tab projections 34 on the insulating hood 18. Accordingly, when the connecting device 10 is assembled, the insulating hood 18 is fixed to the free mounting plate 12.

The slidable frame 14 is seen in FIGS. 1 and 2 to be comprised of major side walls 36 joined at one end by minor side wall 38 and at the other end by an extended vertical wing 40, the wing 40 extending upwardly from upper edge portions of the major side walls 36. The respective ends of the major side walls 36 recurve laterally at the top to form wing-like extensions 42, the extensions 42 extending toward each other between the major side walls 36 in spaced facing relation and spaced apart sufficiently to receive projection 34 on the hood 18 which enables frame 14 to slide in relation to hood 18 and plate 12. Two pair of L-shaped tabs 44 extend laterally inwardly of the major side walls 36 along lower edge portions thereof, the tabs 44 and each pair of tabs being disposed in oppositely facing spaced relation. As can be particularly seen in FIG. 1, the apertures 30 in the free mounting plate 12 lie between the spaced-oppositely facing edge portions of the wing-like extensions 42, the tab projections 34 of the insulating hood 18 extending therebetween and being joined to the free mounting plate 12 through use of the screws 32, as aforesaid.

Figure 3:
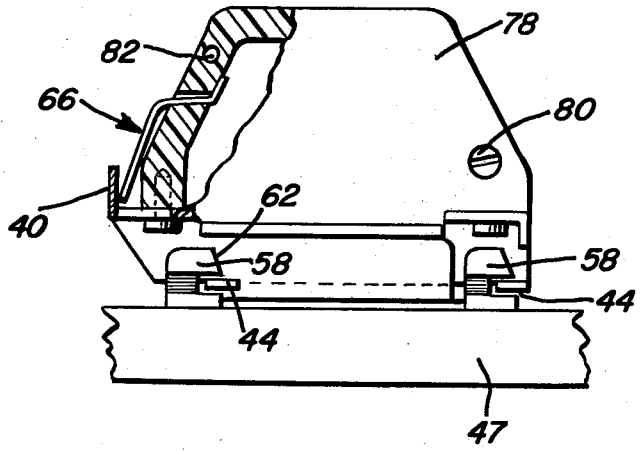
FIG. 3 is a side elevational view partially cut away of the assembled electrical connecting device of the invention, the components of the device being mechanically interconnected for fixed mounting of the male and female connectors in a desired configuration; and, FIG. 4 is a side elevational view in partial section of the present device illustrating release of the slidable locking frame of the structure.
Figure 4:
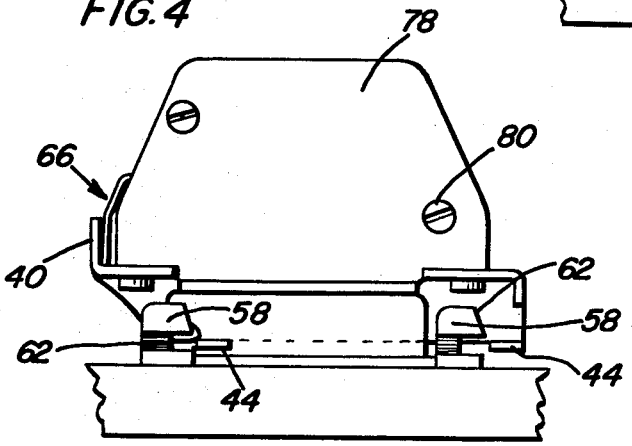

The fixed mounting plate 16 is particularly seen in FIGS. 3 and 4 to be mounted to a stationary structure such as the substrate 47, the substrate 47 typically comprising a fixed structural portion of an electrical apparatus on which the device 10 is used. The fixed mounting plate 16 is best seen in FIG. 1 to have a raised housing 48 formed thereon, the housing 48 being congruent with the lower projecting platform 20 on the free mounting plate 12. In particular, the housing 48 is comprised of a peripheral wall 49 which defines a recess into which the platform 20 is sized to fit. Male connector posts 50 extend from the surface of the plate 16 within the confines of the housing 48. The male connector posts 50 are electrically conductive and are disposed in a pattern identical to the pattern of the apertures 22 formed in the lower projecting platform 20 on the free mounting plate 12. Accordingly, the platform 20 is flushly received within the confines of the raised housing 48, the male connector posts 50 extending into and mating with the apertures 22 in said platform 20. The male connector posts 50 are electrically connected to circuits and/or electrical connectors which extend from the underside of the fixed mounting plate 16 into electrical connection with said posts 50. The electrical connections to the male connector posts 50 are typically of a permanent nature, that is, the electrical conductors (not shown) connecting to the posts 50 from the underside of the fixed mounting plate 16 typically being soldered or otherwise permanently electrically connected to said posts 50. Male connectors (not shown) connected to the ends of insulated electrical conductors, such as would be disposed in a "bundle" of electrical conductors, are received one each in the lumens 28 of the tubular receptacles 26, the electrical connectors being thereby electrically joined to the male connector posts 50 which extend into electrical contact with the tubular receptacles 26 through the apertures 22 in the lower projecting platform 20. The electrical connectors and thus the electrical conductors attached thereto which mate with the tubular receptacles 26 are thereby electrically joined to electrical conductors electrically connected to the male connector posts 50. The electrical interconnections thus made are held together by virtue of the frictional engagement of the male connector posts 50 within the apertures 22. However, as will be described hereinafter, the slidable frame 14 acts to lock the lower projecting platform 20 within the raised housing 48 to prevent accidental dislodgement of the platform 20 from the raised housing 48.

A U-shaped locking member 52 is seen to be disposed at each end of the fixed mounting plate 16, a bight portion 54 of each of the members 52 being flushly disposed against the underside of the plate 16, legs 56 of the members 52 extending upwardly of the upper surface of the plate 16. The legs 56 are seen to extend inwardly at points surmounting the plate 16 to form an angle portion 57, the angle portions 57 terminating, respectively, in snap connector plates 58. The planes of the connector plates 58 can be seen to extend either vertically or slanted slightly inwardly of the fixed mounting plate 16 in order to provide the connecting function described hereinafter. The angle portion 57 of each of the legs 56 is seen to be provided with a recess 60, the recesses 60 in the legs 56 being disposed on the sides of the legs 56 opposite the wing 40 when the device 10 is assembled. The connector plates 58 are further seen to be provided with slanted edge portions 62 which slant outwardly from lower edge portions of said plates 58 on the sides thereof surmounting the recesses 60. The fixed mounting plate 16 can be connected to the locking members 52 by means of screws 64, the screws 64 extending through apertures (not shown) formed in the plate 16 and in the members 52, the screws 64 being further used as desired to connect the fixed mounting plate 16 with the substrate 47.

As can be seen in FIGS. 1, 3 and 4, an S-shaped spring 66 is seen to be formed of a lower portion 65, a midportion 67 and an upper portion 69, the spring 66 functioning as will be described hereinafter to exert pressure on the sliding frame 14 to maintain the frame 14 in an interlocking relation with the fixed mounting plate 16. The insulating hood 18 is seen to be comprised of a U-shaped body 68 having a wall 71 and legs 70 and 72. The leg 70 disposed nearmost to the wing 40 when the device 10 is assembled is formed with a horizontal slot 74, the slot 74 receiving the midportion 67 of the spring 66 thereinto. Therefore, the upper portion 69 of the spring 66 bears against interior wall surfaces of the leg 70, the lower portion 65 of the spring 66 being received between the wing 40 on the slidable frame 14 and exterior wall surfaces of the leg 70 of the insulating hood 18. The lower portion 65 of the spring 66 biases against the wing 40 of the slidable frame 14 to cause pressure to be exerted against the slidable frame 14 which puts the frame 14 and the free mounting plate 12 under tension, the pressure acting to force the slidable frame 14 in a direction toward the end of the device 10 at which the wing 40 is disposed. The leg 72 of the hood 18 has an opening 76 disposed therein, the opening 76 allowing a "bundle" of electrical conductors (not shown) to extend into the interior of the hood 18 for mating with the tubular receptacles 26. As can be particularly seen in FIGS. 3 and 4, the hood 18 is provided with a cover 78 which can be held in place by screws 80 which extend through apertures (not shown) in the cover 78 and into threaded apertures 82 formed in the hood 18.

In operation, the free mounting plate 12 is positioned under the extensions 42 by insertion into the frame 14 from the underside thereof by longitudinal movement between the end tabs 44. The hood 18 and plate 12 are then joined by inserting screws 32 with the lower end 65 of spring 66 disposed against the inner surface of wing 40. The hood 18 and plate 12 are thereby movable relative to the slidable frame 14. The fixed mounting plate 16, as particularly seen in FIGS. 3 and 4, is mounted to the substrate 47 as aforesaid, the raised housing 48 extending upwardly of the fixed mounting plate 16 for engagement with the lower projecting platform 20 extending from the underside of the free mounting plate 12. When the lower projecting platform 20 on the free mounting plate 12 is inserted into the raised housing 48 on the upper surface of the fixed mounting plate 16, the tabs 44 on the underside of the slidable frame 14 engage the inclined cam surfaces 62 on connector plates 58 of the locking members 52, continued downward displacement of the slidable frame 14 causing the tabs 44 to snap-fit within the recesses 60 in the legs 56 of of the members 52. Accordingly, as shown in FIG. 3, the tabs 44 on the slidable frame 14 lock within the recesses 60 in the locking members 52. The spring 66 acts to bias the slidable frame 14 in a direction toward the wing 40 on said frame 14, thereby causing the tabs 44 to be held under tension against the closed ends of the recesses 60. As seen in FIG. 4, pressure on the wing 40 having a horizontal component with a vector direction toward the device 10 biases the lower portion 65 of the spring 66 inwardly, thereby to displace the slidable frame 14 to the right of the drawing as seen in FIG. 4. Accordingly, the tabs 44 are caused to be displaced from the recesses 60 in the locking members 52, the locking function of the frame 14 being thereby discontinued. On sliding movement of the frame 14 by virtue of pressure exerted against the wing 40, the free mounting plate 12 maintains a fixed relation to the fixed mounting plate 16. On displacement of the tabs 44 from the recesses 60, the lower projecting platform 20 can be readily removed from the housing 48 by exertion of an upwardly directed force on either the hood 18, frame 14, or plate 12. Since the hood 18, plate 12 and frame 14 essentially comprise a unitary assembly, even though the plate 12 and hood 18 are movable relative to the frame 14, this assembly can be lifted from the plate 16 when the tabs 44 are not engaged within the recesses 60.

It should be noted that the structure of the device 10 useful for interlocking the frame 14 to the fixed mounting plate 16 does not extend beyond the effective volume of the device 10, several of the devices 10 thereby being capable of being arranged adjacently such that connection and disconnection displacements do not interfere with similar functions of adjacent devices. Due to this particular structure, the devices 10 occupy a minimum volume. The wing 40 on the frame 14 is located at one end of the device 10, the location of the wing 40 being such that when the hood 18 is grasped to remove the free mounting plate 12 from engagement with the fixed mounting plate 16, the wing 40 can be pressed simultaneously to dislodge the tabs 44 from the recesses 60, thereby to disconnect the slidable frame 14 from the fixed mounting plate 16.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for positively and releasably interlocking a multiplicity of male/female electrical connections respectively connected to electrical conductors, comprising:

a frame member having locking tab portions disposed on one side thereof and having a tension plate member disposed on one end thereof;

a free mounting plate received within the frame member, the plate having electrical receptacles extending from one major surface and a raised platform extending from the opposite major surface thereof, the platform having apertures therein communicating with the electrical receptacles, walls of the apertures being connected electrically to the electrical receptacles;

means slidably interconnecting the free mounting plate and frame member;

a stationary mounting plate having male connector posts extending from one major surface thereof, the posts being encompassed by a peripheral wall housing defining a recess in which the raised platform on the free mounting plate is receivable, the male connector posts being formed into a pattern mating with the apertures in the platform, the posts being received one each into one each of the apertures;

locking members disposed on the stationary mounting plate, the locking members comprising leg portions having locking recesses formed therein, the recesses opening in a direction opposite the tension plate member on the frame member when the device is assembled, the locking tab portions on the frame member being received one each within the locking recesses in the locking members;

a spring member having one end biasing against the tension plate member on the frame member; and, means carried by the free mounting plate for contacting the other end of the spring member, the spring member thereby biasing the free mounting plate in a direction opposite the tension plate member on the frame member.

2. The device of claim 1 wherein the last mentioned means comprises an insulation hood carried on the free mounting plate and connected thereto, the hood having an opening in one side thereof for receiving at least a portion of said electrical conductors therethrough for connection with the female electrical connectors.

3. The device of claim 2 and further comprising means for covering the hood.

4. The device of claim 1 wherein the locking members on the stationary mounting plate comprise snap connector plates surmounting the locking recesses, the snap connector plates having slanted edge portions on the sides thereof facing in the same direction as the open ends of the recesses, the slanted edge portions tapering downwardly from upper edges of the snap connector plates, the locking tab portions sliding downwardly along the slanted edge portions of the snap connector plates on displacement of the free mounting plate into engaging relation with the stationary mounting plate to dispose the raised platform within the recess defined by the peripheral wall housing, the locking tab portions snap fitting into the recesses in the locking members due to pressure exerted by the spring member when the locking tab portions confront the open ends of the recesses after full travel thereof along the slanted edge portions.

5. The device of claim 1 wherein the frame member has wing-like extensions extending from opposite sides thereof at opposite ends thereof, pairs of oppositely facing extensions defining a space therebetween, the last-mentioned means comprising a U-shaped insulation hood, said means slidably interconnecting the frame member and free mounting plate including downwardly extending leg portions on the hood, each leg portion having a tab projection at each end extending into the space between the extensions, means connecting the free mounting plate to the tab projections thereby slidably retaining the oppositely facing extensions on the frame member between the free mounting plate and the leg portions of the hood.

6. The device of claim 5 wherein the leg portion of the hood nearmost the tension plate member has a slot disposed therein, and wherein the spring member is S-shaped and has a lower portion, a midportion, and an upper portion, the midportion being received within the slot, the lower portion biasing against the tension plate member, and the upper portion biasing against inner wall surfaces of said leg portion having the slot formed therein.

7. In a device for electrically connecting electrical conductors, an improved interconnecting and positive locking apparatus comprising:

first plate means for mounting a male receptacle member thereon;

second plate means for mounting a female receptacle member thereon, the male receptacle member being receivable into the female receptacle member to electrically join said electrical conductors;

a frame member having a first portion and a second portion;

locking recess means carried on the second plate means for connecting with the frame member;

means carried on the frame member first portion for affixing said first plate means thereto;

said frame member second portion having marginal sections slidably received between said frame member first portion and said first plate means, said frame member second portion also including side walls at least partially enclosing said first plate and connected to tab locking means for mating connection with the locking recess means on the second plate member; and, spring means for biasing the frame member first portion relative to the frame member second portion, the spring means holding the locking recess means and tab locking means in engaged relation, exertion of a force on the frame member opposing the spring means acting to disengage the locking recess means and tab locking means.

* * * * *

UNITED STATES PATENT AND TRADEMARK OFFICE

CERTIFICATE OF CORRECTION

PATENT NO. : 4,172,627

DATED : October 30, 1979

INVENTOR(S) : Andre P. Ricros

It is certified that error appears in the above-identified patent and that said Letters Patent are hereby corrected as shown below:

Page 1, column 1, delete "Andre P. Ricros" and substitute --Andre Poulain (Ricros)--.

Signed and Sealed this

*Eighteenth* Day of *March 1980*

[SEAL]

*Attest:*

SIDNEY A. DIAMOND

*Attesting Officer*

*Commissioner of Patents and Trademarks*